US010590645B2

(12) United States Patent
Fritschi et al.

(10) Patent No.: US 10,590,645 B2
(45) Date of Patent: Mar. 17, 2020

(54) ELEMENT FOR THERMAL INSULATION

(71) Applicant: Schock Bauteile GmbH, Baden-Baden (DE)

(72) Inventors: Hubert Fritschi, Baden-Baden (DE); Werner Venter, Buhl (DE); Andre Weber, Buhl (DE)

(73) Assignee: Schöck Bauteile GmbH, Baden-Baden (DE)

( * ) Notice: Subject to any disclaimer, the term of this patent is extended or adjusted under 35 U.S.C. 154(b) by 0 days.

(21) Appl. No.: 15/657,563

(22) Filed: Jul. 24, 2017

(65) Prior Publication Data

US 2018/0023289 A1 Jan. 25, 2018

(30) Foreign Application Priority Data

Jul. 22, 2016 (DE) ..... 10 2016 113 558
Jul. 22, 2016 (DE) ..... 10 2016 113 559

(51) Int. Cl.
*E04B 1/76* (2006.01)
*E04C 5/07* (2006.01)
(Continued)

(52) U.S. Cl.
CPC ..... *E04B 1/767* (2013.01); *E04B 1/0038* (2013.01); *E04B 1/76* (2013.01); *E04B 1/7637* (2013.01);
(Continued)

(58) Field of Classification Search
CPC ..... E04B 1/0038; E04B 1/76; E04B 1/7637; E04B 1/7675; E04B 2/40
See application file for complete search history.

(56) References Cited

U.S. PATENT DOCUMENTS 4,620,401 A 11/1986 L'Esperance et al.
4,959,940 A * 10/1990 Witschi ..... E04B 1/0038 52/223.13
(Continued)

FOREIGN PATENT DOCUMENTS

AT 514343 12/2014
CH 691606 A5 * 8/2001 ..... E04B 1/0038
(Continued)

OTHER PUBLICATIONS

Michiels Pierre, Machine Translate for EP2060687 (Year: 2009).*
(Continued)

*Primary Examiner* — Babajide A Demuren
(74) *Attorney, Agent, or Firm* — Volpe and Koenig, P.C.

(57) ABSTRACT

An element for thermal insulation between two building parts, including an insulating body to be arranged between the two building parts and reinforcement elements in the form of at least tensile elements, extending in the installed state of the element essentially horizontally and perpendicularly to the essentially horizontal extension of the insulating body through said body, and respectively projecting in the horizontal direction from the insulating body and here allowing a connection to one of the two building parts preferably made from concrete. The tensile reinforcement elements are formed as multi-part composite elements such that at least in the area of the insulating body they exhibit a central section projecting from the insulating body and at least partially being made from fiber-reinforced synthetic material. The tensile reinforcement elements have in an area outside the insulating body at least one anchoring section with geometric and/or material characteristics at least partially deviating from the central section, with the anchoring section being connected to the central section in a connection area. The connection area is arranged distanced from the insulating body. The central section is made from a cylin-
(Continued)

drical rod-shaped and/or tubular material and is provided on its radial exterior, at least in an area between the insulating body and the connection area, with an essentially smooth wall.

13 Claims, 2 Drawing Sheets

(51) Int. Cl.

| | |
|---|---|
| ***E04B 1/00*** | (2006.01) |
| ***E04B 2/40*** | (2006.01) |
| ***E04C 2/22*** | (2006.01) |
| ***E04C 2/24*** | (2006.01) |
| ***E04C 5/12*** | (2006.01) |
| ***E04C 5/16*** | (2006.01) |
| *E04B 1/19* | (2006.01) |
| *E04B 1/74* | (2006.01) |

(52) U.S. Cl.
CPC ..... *E04B 1/7675* (2013.01); *E04B 2/40* (2013.01); *E04C 2/22* (2013.01); *E04C 2/243* (2013.01); *E04C 5/07* (2013.01); *E04C 5/127* (2013.01); *E04C 5/166* (2013.01); *E04B 2001/1996* (2013.01); *E04B 2001/742* (2013.01); *E04B 2103/04* (2013.01); *E04C 5/165* (2013.01)

(56) References Cited

U.S. PATENT DOCUMENTS

| | | | | |
|---|---|---|---|---|
| 8,875,458 | B2 * | 11/2014 | Fritschi | E04B 1/003 52/259 |
| 2010/0095616 | A1 * | 4/2010 | Braasch | C04B 26/10 52/291 |
| 2014/0202102 | A1 * | 7/2014 | Braasch | E04B 1/7604 52/407.1 |

FOREIGN PATENT DOCUMENTS

| | | | | |
|---|---|---|---|---|
| CH | 699960 | A1 * | 5/2010 | E04B 1/0038 |
| CH | 711841 | B1 * | 5/2017 | E04B 1/0038 |
| DE | 3422905 | A1 * | 1/1986 | E04B 1/0038 |
| DE | 3446006 | A1 * | 7/1986 | E04B 1/0038 |
| DE | 277304 | | 3/1990 | |
| DE | 4427962 | A1 * | 2/1996 | E04B 1/0038 |
| DE | 19501824 | A1 * | 7/1996 | E04B 1/0038 |
| DE | 29707378 | U1 * | 6/1997 | E04B 1/0038 |
| DE | 29805137 | U1 * | 5/1998 | E04B 1/0038 |
| DE | 19947912 | | 5/2001 | |
| DE | 19947912 | A1 * | 5/2001 | E04B 1/0038 |
| DE | 19947913 | | 5/2001 | |
| DE | 10161481 | A1 * | 6/2003 | E04B 1/0038 |
| DE | 102004038082 | | 3/2006 | |
| DE | 102006032444 | A1 * | 1/2008 | E04B 1/0038 |
| DE | 102006056916 | A1 * | 6/2008 | E04B 1/0038 |
| DE | 102008049868 | A1 * | 4/2009 | E04B 1/0038 |
| DE | 102008018325 | | 10/2009 | |
| DE | 102010034514 | A1 * | 3/2012 | E04B 1/0038 |
| DE | 202012101574 | | 8/2012 | |
| DE | 102011122589 | A1 * | 7/2013 | E04B 1/0038 |
| DE | 202013006229 | U1 * | 10/2014 | E04B 1/0038 |
| EP | 1088943 | A2 * | 4/2001 | E04B 1/0038 |
| EP | 1148179 | A1 * | 10/2001 | E04B 1/0038 |
| EP | 1564336 | A1 * | 8/2005 | E04B 1/0038 |
| EP | 1627971 | A1 * | 2/2006 | E04B 1/0038 |
| EP | 2000605 | | 12/2008 | |
| EP | 2060687 | A1 * | 5/2009 | E04B 1/0038 |
| EP | 2557243 | A2 * | 2/2013 | E04B 1/0038 |
| JP | 3958335 | B2 * | 8/2007 | E04B 1/0038 |
| WO | 2005035892 | | 4/2005 | |
| WO | WO-2005035892 | A1 * | 4/2005 | E04B 1/0038 |
| WO | 2012071596 | | 6/2012 | |

OTHER PUBLICATIONS

Michiels Pierre, Machine Translate for EP2000605 (Year: 2008).*
Halfen Gmbh & Co KG, Machine Translate for DE29707378 (Year: 1997).*
Schoeck, DE029805137_Machine_translate, Jul. 1998 (Year: 1998).*

* cited by examiner

ELEMENT FOR THERMAL INSULATION

INCORPORATION BY REFERENCE

The following documents are incorporated herein by reference as if fully set forth: German Patent Application No. DE 102016113558.5, filed Jul. 22, 2016; and German Patent Application No. DE 102016113559.3, filed Jul. 22, 2016.

BACKGROUND

The present invention relates to an element for thermal insulation having an insulating body to be arranged between the two building parts and reinforcement elements in the form of at least tensile reinforcement elements, which in an installed state of the element extend essentially horizontally and extend perpendicularly to the essentially horizontal extension of the insulating body through said body, and each project in a horizontal direction from the insulating body and here they can be connected to one of the two building parts.

Various embodiments of elements for thermal insulation are known from prior art, which primarily serve to support building parts projecting from buildings, such as balcony plates, through a thermally insulating building joint. Here, the integrated reinforcement elements ensure the necessary transfer of the force and/or moment, while the insulating body is responsible to separate the two building parts from each other in a thermally insulating fashion while maintaining the joint.

In general, in relevant prior art tensile reinforcement elements are provided, usually produced from a rod-like material made from metal, which particularly in the proximity of the insulating body are made from stainless steel and in the area outside the insulating body are made from rebar. Stainless steel is used in the proximity of the insulating body and/or the building joint on the one hand due to its resistance to corrosion and on the other hand due to its poor thermal conductivity, and thus it is preferred over rebar in the proximity of the insulating body. However, rebar is commonly used in the area outside the insulating body, where neither resistance to corrosion nor thermal insulating features are relevant, since the rebar extends completely inside one of the two building parts.

Recently it has been attempted to further optimize the elements for thermal insulation, with it being tried to produce the tensile reinforcement elements, previously made almost exclusively from metal, now from a synthetic material, because it is considerably more cost effective than stainless steel and additionally it shows even lower thermal conductivity than stainless steel. An example for such an element for thermal insulation with tensile reinforcement elements made from a synthetic material is discernible from DE-U 20 2012 101 574. The tensile reinforcement elements called in this publication tensile release rods are made from fiberglass-reinforced synthetic, allowing two adjacent rods to be respectively connected to each other at their ends via a lateral plate, in order to yield a higher and more stable transfer of tensile forces. It is easily discernible from this type of anchoring two tensile release rods via a lateral plate, cumbersome and causing installation problems when connecting the reinforcement element, that tensile reinforcement elements made from a synthetic are hard to anchor in the adjacent building parts particularly when, as in the described prior art, they are embodied with smooth walls and thus a type of end anchoring is required in the form of a lateral plate.

An alternative solution for the use of tensile reinforcement elements made from fiberglass or carbon fiber reinforced synthetic material is discernible from WO-A 2012/071596, in which the tensile reinforcement elements are made from closed loops, which based on their shape as a loop enter into a positive connection to an abutting building part and this way ensure the required anchoring. Looped tensile reinforcement elements have repeatedly been suggested in prior art; however due to their limited anchoring depth in the abutting building part and the here resulting lower capacity to transfer strong tensile forces they show considerable disadvantages, with the loop shape itself regularly resulting in a collision with the abutting reinforcement and thus leading to installation problems, similar to the above-described lateral plates.

These elements for thermal insulation with reinforcement elements made from a synthetic material were previously not convincing because their anchoring in the abutting building parts failed to attain the problems left unsolved in the past: Here, either the tensile reinforcement elements must generate via special geometries (e.g., by a loop form, lateral plates, and the like) a strong positive connection to the abutting building part, which in turn leads to installation problems due to the connecting reinforcement to be arranged in this area; or it must be attempted to provide the tensile reinforcement elements comprising a fiber-reinforced synthetic in the form of a tubular and/or rod material with a profiling and/or striation at their exterior, with here however the anchoring of these profiled tensile reinforcement elements made from a synthetic material in the abutting building part suffering the disadvantage that the fiber-reinforced synthetic on the one side and the concrete material of the abutting building part on the other side have generally such distinctly different temperature expansion coefficients that automatically different, temperature-related relative movements develop, which lead to tensions and/or expansions in the mutual contact area. This leads to destruction by either the profiling or the so-called concrete bases between the profiling shearing off. This results in the tensile reinforcement elements usually losing their ability to fulfill their function.

Another disadvantage of tensile reinforcement elements made from a synthetic material is the lack of subsequent bending property, compared to steel, which renders it necessary that the desired shape and length of the tensile reinforcement elements is already considered during the production of the rods. This leads to a considerably increased number of tensile reinforcement elements that need to be warehoused due to the accordingly high number of variants, which causes disadvantages with regards to logistics.

SUMMARY

Based on this prior art, the objective of the present invention is to further improve an element for thermal insulation such that the above-described disadvantages of tensile reinforcement elements made from a synthetic material are avoided, and particularly improved anchoring of the tensile reinforcement elements in the adjacent concrete building parts is possible.

This objective is attained in an element for thermal insulation with one or more of the features of the invention.

Advantageous variants of the invention are described below and in the claims, with their wording here being explicitly included in the description by way of reference in order to avoid unnecessary text repetitions.

According to the invention the tensile reinforcement elements are therefore embodied here as multi-part composite elements such that they comprise, at least in the proximity of the insulating body, a central section, which projects from the insulating body and is made at least partially from a fiber-reinforced synthetic material, that in an area outside the insulating body the tensile reinforcement elements comprise at least one anchoring section exhibiting geometric and/or material features at least partially deviating from the central section which is connected in a connection area to the central section, with said connection area being arranged at a distance from the insulating body, that the central section comprises particularly a cylindrical rod and/or tubular material, and on its radial exterior, at least in the area between the insulating body and the connection area, it is essentially formed with a smooth wall.

This material combination is based on the acknowledgement that it is not necessary to forgo the particular advantages of synthetic materials in the proximity of the insulating body only because in the proximity of the abutting building part the synthetic material, due to the anchoring problems, is preferably replaced perhaps by different materials and/or geometries, particularly profiled steel. The result is therefore the above-mentioned multi-part composite element with an unusual material mix, which at least in the proximity of the insulating body comprises a corrosion-resistant and very poorly thermally conducting, fiber-reinforced synthetic material in the form of a cylindrical rod and/or tubular material, and at its radial exterior, at least in the area between the insulating body and the connection area, it is formed essentially with a smooth wall, and in an area outside the insulating body, in the abutting building part, it comprises an anchoring section, which includes materials and/or geometries differing from those of the central section, and this way can be adjusted to the installation conditions given in the adjacent building parts, as is the case in proven metal-tensile rods of prior art, which however have commonly in the area of the insulating body a central section made from stainless steel.

This composite element surprisingly exceeds the tensile reinforcement elements known from prior art in every aspect, since it allows to select the materials used in the insulating body and/or the abutting building parts according to their individual advantages for the different requirements given and to disregard disadvantageous materials and/or geometries. For example, in the proximity of the insulating body a central rod section made from fiber-reinforced synthetic can be used, which is more cost-effective and is considerably less thermally conductive than the stainless steel used in prior art, while in the proximity of the abutting concrete parts no particular requirements are given and thus cost-effective, easily handled and subsequently bendable rebar rods can be used, which can be adapted with appropriate exterior profiling in a simple and cost-effective fashion for an optimal anchoring in the adjacent concrete building parts.

Due to the fact that the anchoring sections are made preferably from steel, they can be anchored in the abutting building parts in a conventional fashion, without the need, as in case of fiber-reinforced synthetic rods, for compensation using exotic deformations (in the form of the above-mentioned lateral plates, loops, etc.) and the installation problems with the connecting reinforcements caused thereby, or when using profiled synthetic rods, due to damages in the mutual contact area, which are triggered by the different expansion coefficients of concrete on the one side and the synthetic rod on the other side. In case of reinforcement rods made from steel however such anchoring occurs usually by profiling the casing area of the reinforcement rods, allowing this profiling to be provided easily during the production process of these reinforcement elements.

Beneficially the anchoring section of the tensile reinforcement elements is fixed at a free end of the corresponding central section. If in this case the anchoring section of the tensile reinforcement elements is arranged aligned to the central section, in the installed state of the element extending essentially in the horizontal direction, here a successive arrangement develops and/or a serial connection of different parts of the tensile reinforcement elements, with each part being arranged here such that it shows the most beneficial material features for its position.

In this context it is particularly preferred for the central section to comprise a tensile reinforcement element at its two free ends with respectively an anchoring section, and this way the intended alternating arrangement of anchoring section, central section made from fiber-reinforced synthetic material, and once more anchoring section develops.

With regards to the materials of the multi-part composite element, namely the tensile reinforcement element, it is preferred that the anchoring section is made from rebar, which exhibits a temperature coefficient, i.e. a thermal expansion similar to the temperature coefficient and/or thermal expansion of concrete and thus can follow to respective temperature-related deformations and/or expansions of the concrete without any destructions. Furthermore it is preferred that the central section of the tensile reinforcement element is made from fiber-reinforced, and particularly fiberglass-reinforced, synthetic material, which on the one hand can be sufficiently stressed in the direction of tensile forces and on the other hand exhibits poor thermal conductivity, which is desired in the proximity of the insulating body. It shall be pointed out that the formulation "fiber-reinforced synthetic material" also includes such fiber-reinforcements, particularly fiberglass reinforcements, with their fiber ratio, particularly fiberglass ratio exceeding 85% by weight, so that the weight of the matrix material used in addition to the fibers, such a synthetic resin, is less than 15% compared to the weight of the reinforcement element.

Similar to the tensile reinforcement elements of prior art, here too the option is given to produce the tensile reinforcement elements from a tubular or rod-shaped material, namely both in the area of the anchoring section as well as the central section. The tensile reinforcement elements and particularly the tubular or rod-shaped material can be provided with a profiling or ribs at their outside in order to enter into the desired positive connection to the adjacent concrete building parts, which ensures the required anchoring of the tensile reinforcement elements in the adjacent building parts.

By suitable geometries and dimensions the anchoring section and the corresponding central section can be fastened to each other such that they are capable of optimally transfer tensile forces and thus can fulfill their intended function. With regards to the mutual fixation, it is recommended to use here form-fitting, force-fitting, and/or material-to-material measures, such as a sleeve joint as disclosed for example in DE-A 102008018325, an adhesion, or a threaded connection, or the like.

Additionally, particularly a welded connection is recommended, which is beneficial particularly when an interior anchoring element is used in the central section, comprising a synthetic fiber-reinforced material that cannot be welded, as the welding aid, the so-called welding insert. This internally anchored element can be inserted into the central section at any arbitrary point of time, for example by screwing it in; however it is advantageous for the internal anchoring element to be already formed directly during the production of the central section and/or laminated therein.

While this interior anchoring element, particularly when it is already inserted during the production of the central section, can extend theoretically over the entire length of the central section in order to particularly also ensure reliable transfer of tensile forces, it may be particularly advantageous if this interior anchoring element extends in the axial direction only over a portion in order to avoid the formation of any thermal bridges. When a continuous metal interior anchoring element is used as a welding aid this automatically results in the insulating function of the central section comprising fiber-reinforced synthetic being interrupted and compromised. In order to achieve that the interior anchoring element, extending only over a partial area in the axial direction, is suitable to compensate the tensile force of the anchoring section to be connected, it must be appropriately anchored and/or supported in the central section, for example by a positive connection.

With regards to the interior anchoring element extending over the entire length of the central section, in order to improve the thermal insulation features it may exhibit a greater material cross-section respectively in the provided welding area than in the axial portion outside this welding area, particularly between two welding areas. This can occur for example even in case of a continuous production of the material for the central section by a chain arrangement, i.e. an alternating arrangement of welded sections and connection members. For this purpose, respectively at the predetermined areas in which an anchoring section shall be connected to the central section, the welding section of the welding aid is to exhibit an enlarged material cross-section sufficient for the welding process, while the connection members in the connection areas between two welding areas show a material cross-section which is reduced in reference thereto and comprises a material suitable for transferring tensile force, for example a steel rope.

The anchoring section may be connected via induction welding, laser welding, or similar welding methods to the interior anchoring element, which are suitable for the synthetic material of the central section.

Due to the fact that the rebar of the anchoring sections at the end position must have a minimum concrete covering, for reasons of protection from corrosion, the anchoring sections may not extend to the insulating body itself in order to prevent any corrosion of the anchoring sections. For this reason it is beneficially provided that the connection area in the installed state has a horizontal distance $L_1$ from the insulating body, which is at least equivalent and maximally five-times the size of the diameter $d_M$ of the central section. This way, the fixation of the anchoring section at the central section can occur outside the insulating body at an area which is protected from corrosion by the required minimum concrete coverage.

The separation of the connection area from the insulating body exhibits however another essential effect and advantage: According to the invention the central section is embodied at its radial exterior, at least in the area between the insulating body and the connection area, essentially with a smooth wall. This avoids excessive bonding between the central section and the material of the adjacent building part surrounding the central section and here a buffer zone is formed, which ensures that the rigidity of the tensile reinforcement elements when leaving the insulating body and entering the adjacent building part change not abruptly but only gradually. Here, an abrupt change in rigidity would result in high stress in the tensile reinforcement element at the frontal edge of the adjacent building as well: On the one hand excessive stress can lead to a delamination of the tensile reinforcement elements comprising fiber-reinforced synthetic material; on the other hand the building material may split off at the front edge of the adjacent building part, which in turn destroys and/or reduces the minimum concrete coverage required and thus the protection from corrosion of the tensile reinforcement element.

The essentially smooth-walled central section serves therefore to prevent any anchoring of the tensile reinforcement element in the adjacent building part near the joint and this way the anchoring occurs only in the connection area as well as the following area of the tensile reinforcement element following in the serial direction, namely the anchoring section. When the connection area is moved away from the edge area near the joint and/or the insulating body into the adjacent building part, the length of the sections of the tensile reinforcement element with reduced rigidity is increased. This way the tensile reinforcement elements clamped in this fashion overall become more pliable and are more capable of following the temperature-related relative movements between the adjacent building parts in the lateral and/or shifting direction. This increase in bending and/or shifting capacity prevents excessively fast and/or strong fatigue of the tensile reinforcement elements.

While in prior art instructions can be found such that the free, i.e. not radially supported length of a tensile reinforcement element made from fiber-reinforced synthetic material must be sized as short as possible between the two clamping sites, in order to keep the overall expansion of the tensile reinforcement element as short as possible in the axial direction, the object of the present invention intentionally tolerates such an increase in axial expansion by moving the clamping sites away from the insulating body into the adjacent building parts in order to this way render the tensile reinforcement elements with better bending properties, which advantageously results in the desired reduction of material fatigue.

In other words: If as common in prior art a tensile reinforcement element made from a synthetic material is provided with a profiled casing surface and it is inserted directly into an adjacent concrete building part and anchored there, here the area with reduced rigidity would be limited to the size of the insulating body. It is obvious that such a rigid tensile reinforcement element will not be able to follow the common temperature-related relative movements of the two adjacent building parts to a sufficient extent. Simultaneously the tensile reinforcement element would show in the transitional area between the insulating body and the adjacent building part a leap in rigidity by the abrupt transition between the different surrounding materials, which resulted in excessive stress, perhaps leading to destructions of the tensile reinforcement element as well as the material of the adjacent building part.

Although depending on the connection technology chosen the length $L_2$ of the connection area between the central section and the anchoring areas exhibits different sizes, in most cases the connection technology ensures that the anchoring section in the connection area, subject to corrosion and preferably made from rebar, is shielded in the connection area by the synthetic material of the central section such that the distance from the insulating body and thus the joint between the two adjacent building parts is appropriately enlarged. This way, in those cases the length $L_2$ of the connection area itself can be considered when determining the minimum concrete coverage, if the anchoring section per se is arranged too closely to the insulating body and thus the joint, because the central section surrounding the anchoring area ensures for the required protection from corrosion. The advantage of the present invention therefor also includes that the connection area in the installed state has a length $L_2$ in the horizontal direction, which is at least twice and maximally 10 times the size of the diameter $d_V$ of the anchoring section.

In order to allow providing the required anchoring of the tensile reinforcement elements in the adjacent building parts in the installed state, the anchoring section should, starting from the connection area, extend in the horizontal direction over a length $L_3$, which is at least 20-times the size of the diameter $d_V$ of the anchoring section. This way it is ensured that the tensile reinforcement elements according to the invention can be used without requiring anchors at their ends, such as lateral plates, loops, etc. and still ensure the desired anchoring effect, and this even in light of the background that the smooth-walled section of the central section between the insulating body and the connection body contributes not and the connection area itself contributes hardly to the anchoring effect.

The element for thermal insulation according to the invention beneficially comprises, in addition to the tensile reinforcement elements, as known from the related prior art and common in such elements for thermal insulation, compression elements and/or lateral force elements for transferring compressive and/or lateral forces between the adjacent building parts.

To the extent that here the material of the adjacent building parts is discussed, thus particularly of the building and the projecting exterior part made from concrete, this shall be understood as any form of building material that can cure and/or set, particularly a cement-containing, fiber-reinforced construction material such as concrete, high-strength or ultrahigh-strength concrete, or high-strength or ultrahigh-strength mortar, a synthetic resin mixture, or a reaction resin molding mixture.

BRIEF DESCRIPTION OF THE DRAWINGS

Additional features and advantages of the present invention are discernible from the following description of exemplary embodiments based on the drawings, in which.

DETAILED DESCRIPTION OF THE PREFERRED EMBODIMENTS

Figure 1:
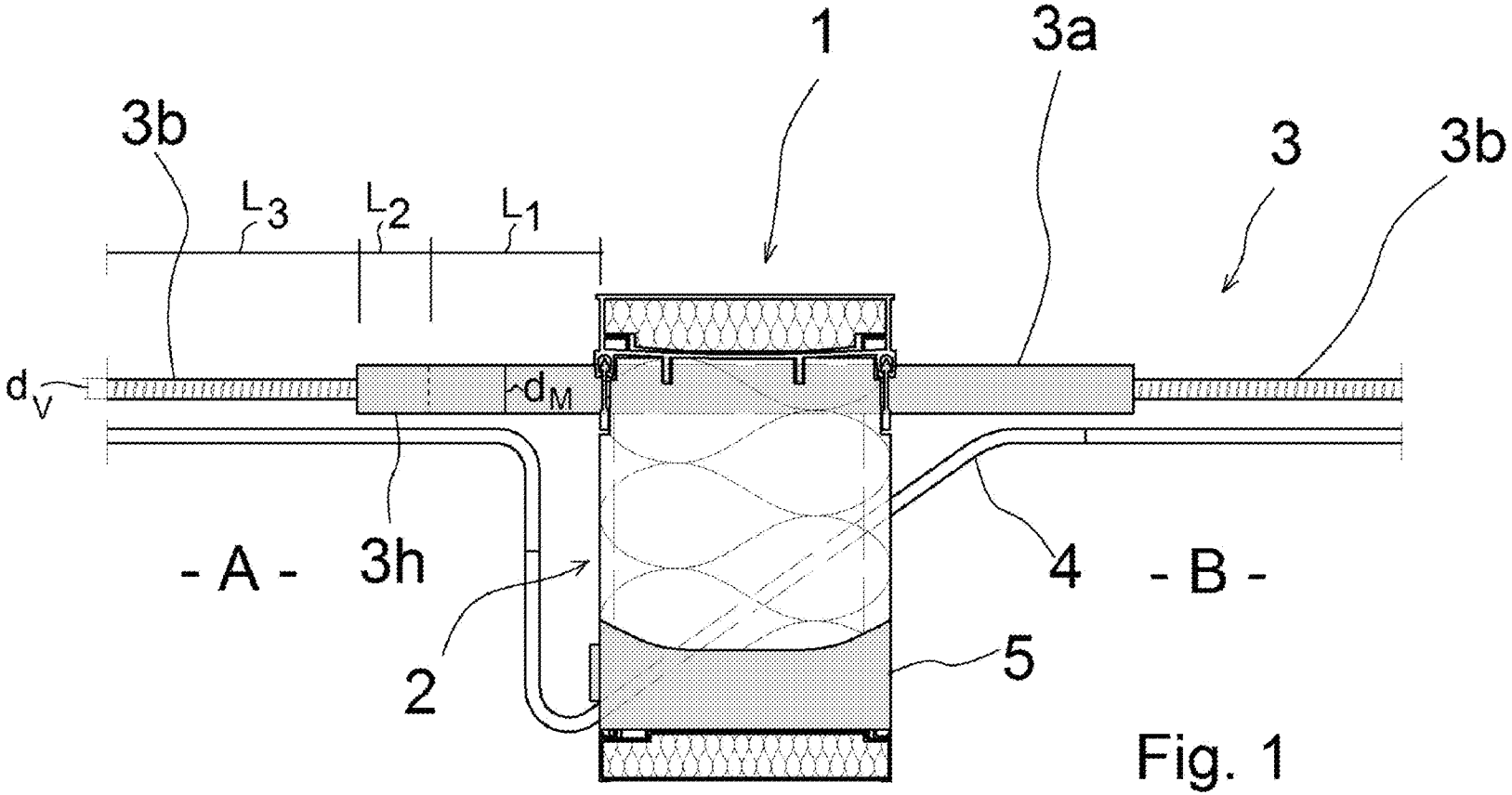
FIG. 1 shows an element for thermal insulation according to the invention in a schematic and partially cross-sectioned side view.

FIG. 1 shows an element for thermal insulation 1 with a multi-part cuboid-shaped insulating body 2, which is provided for an arrangement in a building joint remaining between two concrete building parts (which are not shown here, but with their position being indicated by the reference characters A, B) for the purpose of separating these to concrete building parts A, B from each other in a thermally insulating fashion. The insulating body 2 is assembled from several parts in order to allow the installation of reinforcement elements in the form of tensile rods 3, in the form of lateral force rods 4, and in the form of compression elements 5.

The arrangement of the reinforcement elements occurs in a manner known from prior art and common, namely by arranging the tensile reinforcement elements 3 in the upper area of the insulating body 2, which in the installed state extend in the horizontal direction and serve for the transfer of tensile forces between the two building parts A, B connected to the element for thermal insulation and for this purpose are anchored in these building parts.

In the lower section, the so-called compression zone of the insulating body 2, the compression elements 5 are arranged, namely also in the horizontal direction of extension, with them however not projecting from the insulating body 2. Finally, lateral force rods 4 are provided, which are positioned in the area of the insulating body 2 in an inclined fashion in reference to the horizontal and extend from the reinforcement elements of the element for thermal insulation diagonally downwards, matching the stress to be compensated, from the tensile zone on one side of the insulating body to the compression zone on the other size of the insulating body, in order to here extend vertically in the direction of the tensile zones angled upwards and then, after another angle, parallel to the tensile reinforcement elements.

The tensile reinforcement elements 3 are essential for the present invention, with FIG. 1 showing a tubular central section 3*a* made from a fiber reinforced synthetic material which extends in the area of the insulating body 2 in the horizontal direction and projects slightly in the horizontal direction at both sides of the insulating body, namely by an axial length $L_1+L_2$ and in this projecting area, in the installed state, is arranged in the area of the adjacent building parts A, B. The length $L_2$ indicates the area in which the central section 3*a* and the anchoring section 3*b* overlap and here form a connection area 3*h*, with the diameter of the central area $d_M$ being greater than the diameter of the anchoring area $d_V$, and thus it encompasses the central area of the anchoring section.

The length $L_1$ in turn represents the axial distance of the connection area 3*h* from the insulating body 2. And the length $L_3$ states the length by which the anchoring section 3*b*, starting from the connection area 3*b* and/or the face of the central area 3*a*, extends into the building part A. FIG. 1 shows not the full length of the anchoring section 3*a* and thus the size of the length $L_3$ in FIG. 1 is not equivalent to the overall length of the anchoring section 3*b*, either.

The tensile reinforcement element 3 of FIG. 1 additionally comprises rod-shaped anchoring sections 3*b* made from rebar, which are inserted into the tubular material of the central section and fixated here.

Figure 2:
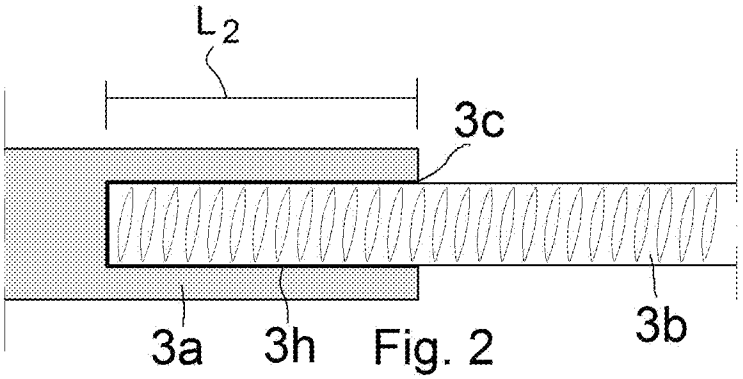
FIGS. 2 to 6 show various exemplary variants for the mutual fixation of the central section made from a fiber-reinforced synthetic material and an anchoring section made from rebar.

Suitable examples for the mutual fixation of the central section and the anchoring section are discernible from FIGS. 2 to 6, which shall be explained in greater detail in the following:

FIG. 2 shows the insertion of the anchoring section 3*b* into a cylindrical bore 3*c* of the central section 3*a*. The mutual connection of the central section and the anchoring section can occur for example by a press-fit connection and/or supported by the additional use of adhesives, in order to generate an actually stable connection, which is capable to transfer tensile forces. The axial length in which the anchoring section 3*b* and the central section 3*b* overlap is indicated with the reference character $L_2$, both in FIG. 1 as well as in FIG. 2, and is equivalent to the axial length of the connection area 3*h*.

Figure 3:
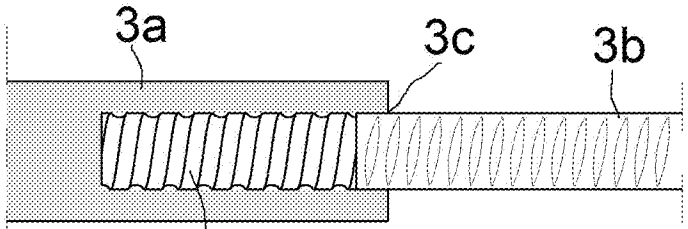

FIG. 3 shows a variant thereof, in which the free end 3*d* of the anchoring section 3*b*, inserted in the free end and the tubular material of the central section 3*a*, is provided on its exterior with a profiling, which allow adhesive, mortar, or similar connection means to have more space to enter into a positive connection to the profiling in order to improve and/or ensure the mutual connection.

Figure 4:
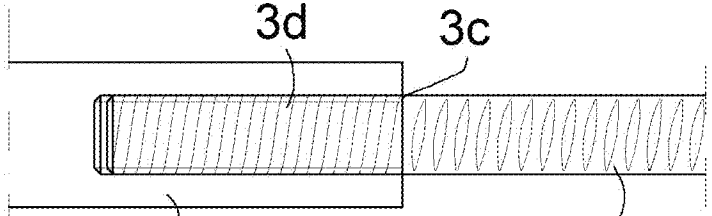

In FIG. 4 the free end 3*d* of the anchoring section 3*b* is provided with an external thread and penetrates the cylindrical opening 3*c* of the central section 3*a*, which opening 3*c* in turn shows an internal thread and this way allows the threaded connection of the anchoring section 3*b* and the central section 3*a*.

Figure 5:
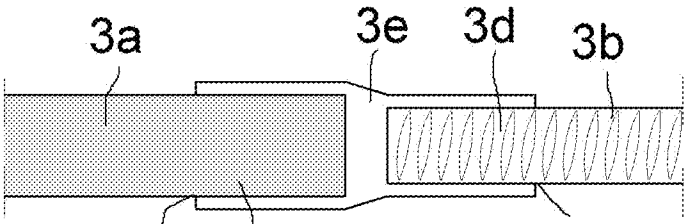
Figure 6:
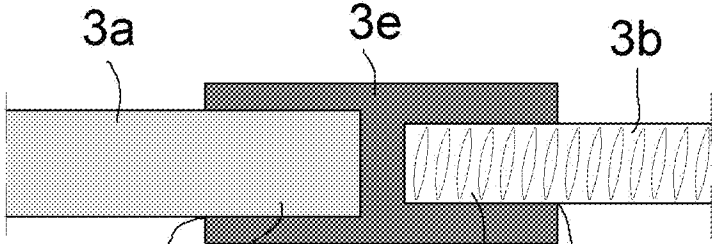

FIGS. 5 and 6 show finally two sleeve joints, thus the mutual fixation of anchoring section 3*b* and the central section 3*a* with a sleeve being interposed, which comprise at their two mutually opposite sides two bores 3*f*, 3*g* aligned to each other, with the two bores however being arranged in the sleeve such that they show no mutual connection. One bore 3*g* is therefore provided to receive the free end 3*d* of the anchoring section 3*b*, either via a simple plug-in connection or with the additional use of adhesives or other connection means. On the other side of the sleeve 3*e* finally a bore 3*f* is provided, into which the free end 3*h* of the central section 3*a* is inserted and fixed here, for example via a press-fit connection, plug-in connection, or adhesion.

As discernible from FIG. 1, the central section 3*a* extends with its synthetic material far beyond the insulating body and allows therefore the anchoring sections 3*b*, made from rebar, to be connected to the central section 3*a* in an area, which is not at risk for corrosion. This way the advantages according to the invention can be yielded, namely in the area of the insulating body allowing the use of the particularly advantageous synthetic material of the central section, which is primarily characterized in the better costs compared to stainless steel and a particularly poor thermal conductivity. And additionally in the area outside the insulating body, finally in the area of the building parts, the anchoring areas can be made from rebar which has similar temperature expansion coefficients as the surrounding concrete of the building parts, and thus can enter into an optimal connection to the concrete, by which the tensile force can be transferred from the concrete to the tensile reinforcement element and vice versa, without here the otherwise developing destructions occurring due to excessive relative movements.

In summary, the present invention provides the advantage to provide an element for thermal insulation which comprises tensile reinforcement elements in the form of multi-part composite elements, comprising a central section made from fiber-reinforced synthetic material on the one side and at least an anchoring section made from steel and particularly rebar, on the other side. This way, the various materials can be used precisely according to their characteristics and advantages, which was not possible in this way in prior art.

LIST OF REFERENCE CHARACTERS

1—element for thermal insulation
2—insulating body
3—tensile rods
3*a*—central section
3*b*—anchoring sections
3*c*—cylindrical opening of the central section 3*a*
3*d*—free end of the anchoring section 3*b*
3*e*—sleeve
3*f*—bore in the sleeve 3*e* for the anchoring section 3*b*
3*g*—bore in the sleeve 3*e* for the central section 3*a*
3*h*—connection area
4—lateral force rods
5—pressure elements
A—concrete building part
B—concrete building part
$d_M$—diameter of the central section
$d_V$—diameter of the anchoring section
$L_1$—axial distance of the connection area 3*h* from the insulating body
$L_2$—length of the connection area 3*h* in the axial direction
$L_3$—size the anchoring rod section extends from the connection area 3*g* into the building part A and/or B

The invention claimed is:

1. An element for thermal insulation between two building parts, comprising an insulating body (2) adapted to be arranged between the two building parts, reinforcement elements comprising at least tensile reinforcement elements (3), which in an installed state of the element (1) extend horizontally and extend perpendicularly to a horizontal extension of the insulating body through said body, and each said tensile reinforcement element projects in a horizontal direction from the insulating body and here is adapted to be connected to one of the two building parts, the tensile reinforcement elements (3) are embodied as multi-part composite elements and, at least in an area of the insulating body (2), comprise a central section (3*a*) which projects from the insulating body and is made at least partially from a fiber reinforced synthetic material, and in an area outside the insulating body (2), comprise at least one anchoring section (3*b*) with at least one of geometric or material characteristics at least partially deviating from the central section (3*a*), that is connected in a connection area (3*h*) to the central section (3*a*), the connection area (3*h*) being arranged distanced from the insulating body, and the central section (3*a*) is made, at least in the connection area (3*h*), from a tubular material and has on a radial exterior thereof, at least in an area between the insulating body (2) and the connection area (3*h*), an essentially smooth wall, wherein the anchoring section (3*b*) and the corresponding central section (3*a*) are fixed to each other in the connection area (3*h*) in at least one of a form-fitting, force-fitting, or material-to-material fashion, and an interior anchor inserted into the central section as a welding aid for the central section, and the insertion of the interior anchor in the central section occurs during production of the central section.

2. The element for thermal insulation according to claim 1, wherein the at least one anchoring section (3*b*) of the tensile reinforcement element (3) is connected at a free end of the corresponding central section (3*a*), is arranged aligned to the central section (3*a*), and in the installed state of the element (1) essentially extending horizontally.

3. The element for thermal insulation according claim 2, wherein the at least one anchoring section comprises two of the anchoring sections, with one of the anchoring sections being located at each respective free end of the central section (3*a*) of the tensile reinforcement element.

4. The element for thermal insulation according to claim 1, wherein the anchoring section (3*b*) of the tensile reinforcement elements (3) is made from steel.

5. The element for thermal insulation according to claim 1, wherein the central section (3*a*) of the tensile reinforcement elements (3) is made from fiberglass-reinforced synthetic material.

6. The element for thermal insulation according to claim 1, wherein at least one of the anchoring section (3*b*) of the tensile reinforcement elements (3) or the central section (3*a*)

of the tensile reinforcement elements (3) is made from at least one of a rod-shaped or tubular material.

7. The element for thermal insulation according to claim 1, wherein the anchoring section (3*b*) of the tensile reinforcement elements (3) comprises at an exterior thereof a profiling projecting radially outwardly relative to the central section (3*a*).

8. The element for thermal insulation according to claim 1, wherein a mutual fixation of the anchoring section (3*b*) and the corresponding central section (3*a*) comprises at least one of a sleeve connection (3*e*), an adhesion, or a threaded connection.

9. The element for thermal insulation according to claim 1, wherein a mutual fixation of the anchoring section of the tensile reinforcement elements and the corresponding central section occurs via a welded connection to the interior anchor.

10. The element for thermal insulation according to claim 1, wherein the connection area (3*h*) in the installed state has a horizontal distance ($L_1$) from the insulating body (2) which is at least equivalent to and maximally five times a size of a diameter ($d_M$) of the central section (3*a*).

11. The element for thermal insulation according to claim 1, wherein the connection area (3*h*) in the installed state has a length ($L_2$) in the horizontal direction, which is at least twice and maximally ten times a size of a diameter ($d_V$) of the anchoring section (3*b*).

12. The element for thermal insulation according to claim 1, wherein the anchoring section (3*b*) in the installed state extends, starting from the connection area (3*h*), in the horizontal direction over a length ($L_3$), which is at least twenty times a size of the diameter ($d_V$) of the anchoring section (3*b*).

13. The element for thermal insulation according to claim 1, further comprising at least one of compression elements (5) or lateral force elements (4).

* * * * *